US006453719B1

(12) United States Patent
Heskey et al.

(10) Patent No.: US 6,453,719 B1
(45) Date of Patent: Sep. 24, 2002

(54) HYDRAULIC TOOL WITH FORWARD SURROUNDING RESERVOIR

(75) Inventors: George T. Heskey, Derry, NH (US); Raymond G. Lavoie, Pembroke, NH (US); Gordon L. Steltzer, New Boston, NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/627,879

(22) Filed: Jul. 28, 2000

(51) Int. Cl.[7] ..... B21J 9/14
(52) U.S. Cl. ..... 72/453.16; 60/477
(58) Field of Search ..... 72/453.16, 453.17; 60/477, 479

(56) References Cited

U.S. PATENT DOCUMENTS 3,030,838 A * 4/1962 Klingler ..... 72/453.16
4,342,216 A * 8/1982 Gregory ..... 72/453.16
5,272,811 A 12/1993 Armand ..... 30/228
5,282,378 A * 2/1994 Kimura ..... 72/453.16
5,472,322 A 12/1995 Huet et al. ..... 417/415
5,727,417 A 3/1998 Moffatt et al. ..... 72/453.03
5,782,128 A * 7/1998 Barjesteh et al. ..... 72/453.16
5,802,850 A * 9/1998 Kimura ..... 60/477

FOREIGN PATENT DOCUMENTS

FR 2 644 383 9/1990
FR 2 724 422 3/1996

* cited by examiner

*Primary Examiner*—Lowell A. Larson
(74) *Attorney, Agent, or Firm*—Harrington & Smith, LLP

(57) ABSTRACT

A hydraulically actuated tool comprising a frame; a hydraulic fluid pump connected to the frame; a ram movably connected to the frame and adapted to be moved relative to the frame by hydraulic fluid pumped by the pump; and a hydraulic fluid reservoir connected to the pump. The reservoir is located proximate an exterior portion of the frame along a path of at least about 180°0 relative to a longitudinal axis of the tool. The reservoir does not extend beyond a rear end of the frame.

20 Claims, 4 Drawing Sheets

HYDRAULIC TOOL WITH FORWARD SURROUNDING RESERVOIR

BACKGROUND OF THE INVENTION

1. Field of the Invention

The present invention relates to hydraulic tools and, more particularly, to a reservoir of a hydraulic tool.

2. Prior Art

U.S. Pat. No. 5,727,417 discloses a portable battery powered crimper having a hydraulic drive assembly with a wobble plate. U.S. Pat. No. 5,472,322 discloses a hydraulic fluid tank with a flexible membrane. There is a desire to shorten the length of hydraulic tools to thereby decrease the weight of the tools.

SUMMARY OF THE INVENTION

In accordance with one embodiment of the present invention, a hydraulically actuated tool is provided comprising a frame; a hydraulic fluid pump connected to the frame; a ram movably connected to the frame and adapted to be moved relative to the frame by hydraulic fluid pumped by the pump; and a hydraulic fluid reservoir connected to the pump. The reservoir is located proximate an exterior portion of the frame along a path of at least about 180° relative to a longitudinal axis of the tool. The reservoir does not extend beyond a rear end of the frame.

In accordance with another embodiment of the present invention, a battery powered hydraulic compression tool is provided comprising a frame, a hydraulic fluid pump on the frame, a hydraulic fluid reservoir connected to the pump, and a ram movably connected to the frame. The improvement comprises the hydraulic fluid reservoir having a general ring shape surrounding a portion of the frame.

In accordance with another embodiment of the present invention, a battery powered hydraulic compression tool is provided comprising a frame, a hydraulic fluid pump on the frame, a hydraulic fluid reservoir connected to the pump, and a ram movably connected to the frame. The improvement comprises the hydraulic fluid reservoir having a general ring shape surrounding the pump.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
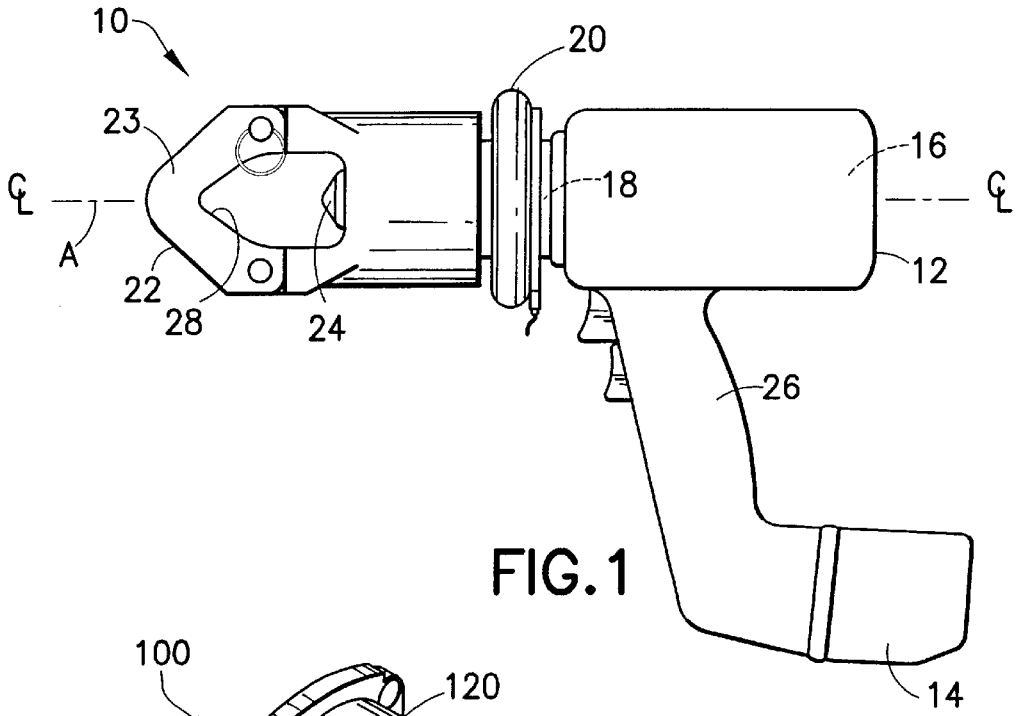
FIG. 1 is a side elevational view of a battery powered hydraulic crimping tool incorporating features of the present invention.

FIG. 1 shows a side elevational view of a tool 10 incorporating features of the present invention. Although the present invention will be described with reference to the embodiments shown in the drawings, it should be understood that the present invention may be embodied in many forms of alternate embodiment. In addition, any suitable size, shape or type of elements, members or materials could be used.

The tool 10 is a battery powered hydraulic crimping tool. However, in alternate embodiments features of the present invention could be used in hydraulic tools which are not battery powered and/or hydraulic tools other than electrical connector crimpers. The tool 10 generally comprises a housing 12, a removable battery 14, an electric motor 16, a hydraulic pump 18, a hydraulic fluid reservoir 20, and a working head 22 having a movable ram 24. The housing 12 in this embodiment forms a handle section 26. However, any suitable housing or handle could be provided. The battery 14 is preferably a removable rechargeable battery. The electric motor 16 is adapted to operably move the pump 18. However, features of the present invention could be used in a manually actuated hydraulic tool or an electrically powered tool not having a battery. An alternate embodiment might also include a non-removable battery. The working head 22 includes a frame 23 which forms an anvil surface 28 opposite a front end of the ram 24. In this embodiment the working head 22 is a die-less working head (i.e.: no crimping dies are used). However, in an alternate embodiment the frame of the working head and the ram 24 could be adapted to receive removable crimping dies or cutting dies.

Figure 2:
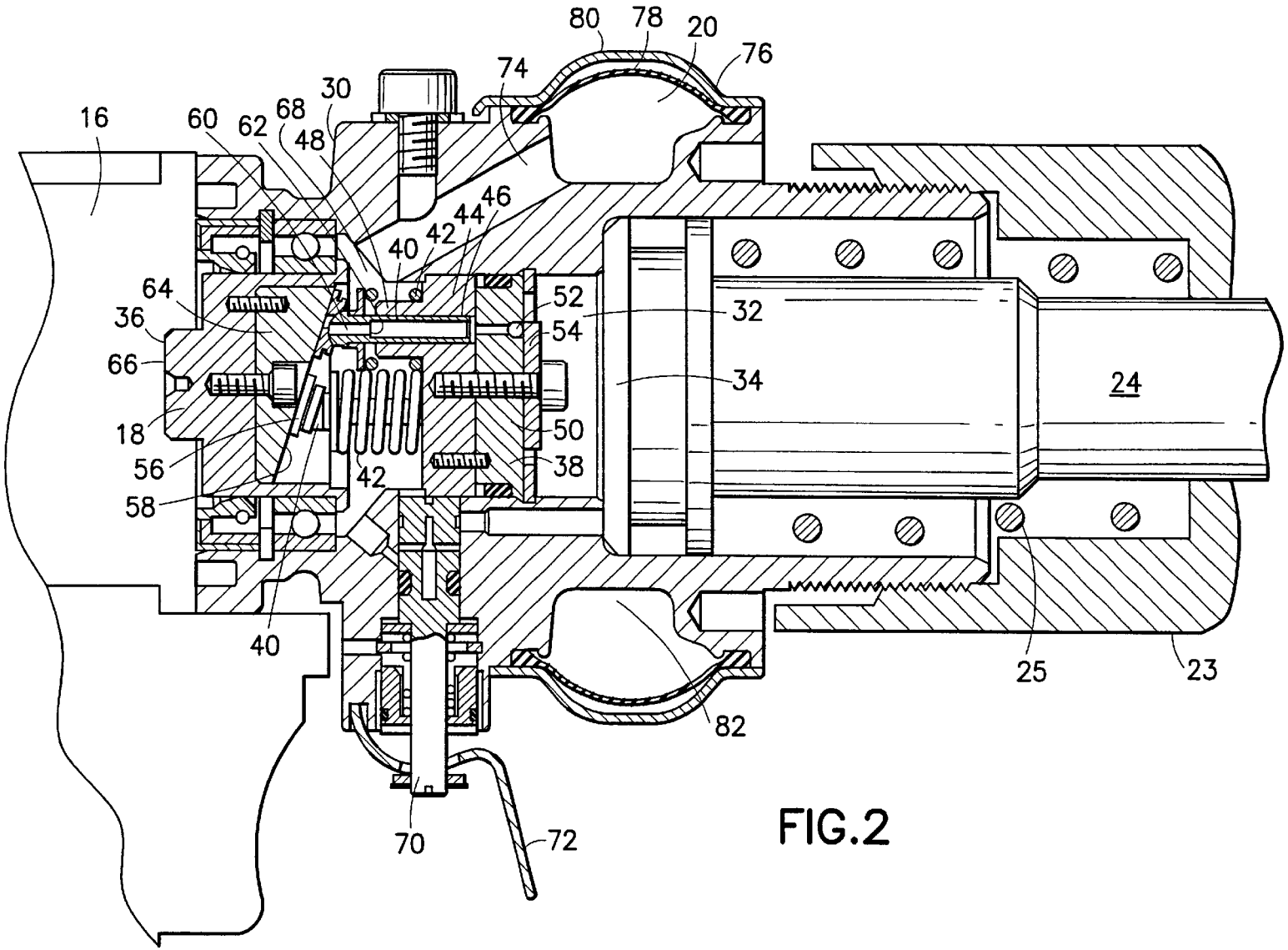
FIG. 2 is a partial cross-sectional view of the tool shown in FIG. 1.

Referring also to FIG. 2, the tool 10 includes a frame member 30 which connects the motor 16 to the rear end of the frame 23 of the working head 22. The frame member 30, in the embodiment shown, is a one-piece member which forms a housing for the pump 18, part of the hydraulic fluid reservoir 20, and hydraulic chamber 32 for the rear end 34 of the ram 24. However, in an alternate embodiment the frame member 30 could be comprised of multiple members and can contribute to fewer or more features. The pump 18 generally comprises a rotatable assembly 36, a substantially rotationally stationary assembly 38, pistons 40 and piston springs 42. The substantially rotationally stationary assembly 38 generally comprises a first member 44 with piston movement areas 46 and spring mounts 48, and a second member 50 with ball check valves 52 aligned with each piston movement area 46 and biased by a washer 54 towards a closed position. In this embodiment the pump 18 comprises three pistons 40 and associated respective piston movement areas 46 and ball check valves 52 equally spaced about a center axis of the pump. However, any suitable number or arrangement could be provided. The pistons 40 are located in the piston movement areas 46 for reciprocal movement and are biased by the springs 42 towards the rotatable assembly 36. Rear ends of the pistons 40 pivotably sit on seats 56. The seats 56 slidably rest against a slanted surface 58 of the rotatable assembly 36. The pistons 40 each have a through hole or conduit 60 and push surface 62. The rotatable assembly 36 generally comprises a wobble drive member 64 and a mount 66 for connecting the wobble drive member 64 to the electric motor 16, such as via reduction gears (not shown). The slanted surface 58 comprises the front surface of the wobble drive member 64. When the electric motor 16 is actuated, it rotates the rotatable assembly 36 such that the rotating slanted surface 58 and springs 42 cooperate to reciprocally move the pistons 40 to pump hydraulic fluid from a flood area 68 past the check valves 52 into the chamber 32 to push the rear end 34 of the ram 24 forward. Hydraulic fluid can be relieved from the chamber 32, by manual actuation of relief valve assembly 70 and trigger 72, back into the flood area 68. The tool can comprise a spring 25 for moving the ram 24 back to its retracted position. The flood area 68 surrounds the pistons 40 and provides a continuous supply of hydraulic fluid which can enter into the through holes at the rear ends of the pistons 40 at the seats 56. However, in alternate embodiments any suitable pump or relief system could be used.

In order to supply the pump 18 and flood area 68 with an adequate supply of hydraulic fluid for the full extension range of movement of the ram 24. The flood area 68 is connected to the reservoir 20 by a single channel or conduit 74 through the frame member 30. In this embodiment the tool 10 does not comprise any check valves between the reservoir 20 and the flood area 68. In alternate embodiments the tool could have multiple conduits between the reservoir 20 and the flood area 68, and/or could include check valve(s). The reservoir 20 includes a containment wall 76 connected to the frame member 30. In this embodiment the containment wall 76 comprises a resilient member 78 and a rigid cover 80. The resilient member or bladder 78 is able to expand and contract as hydraulic fluid is moved into and out of the reservoir 20. Cover 80 prevents the bladder 78 from being inadvertently damaged. The containment wall 76 is connected to an exterior side of the frame member 30. In this embodiment the frame member 30 includes a groove 82 along the exterior surface. The groove 82 has a general annular or circumferential shape. However, in alternate embodiments, the groove 82 of the frame member 30 could comprise more than one groove, have an alternative shape (s), or not fully surround the frame member 30. Multiple reservoirs could also be provided. The reservoir 20 is formed by a combination of the groove 82 and the containment wall 76 surrounding the groove. However, in an alternate embodiment the frame member 30 might not have a groove; the reservoir being defined by the containment wall and a non-grooved surface of the frame member. Alternatively, the containment wall could substantially completely define the reservoir with a connection being provided to the conduit 74. In the embodiment shown, the reservoir 20 has a general ring shape, but need not be uniformly circular or round. The reservoir 20 could have a partial ring or split ended ring shape or extend less than 360° around the frame member; such as only about 180°. However, any suitable angle could be provided, such as 120°–360°. Preferably, the reservoir 20 uses an outer surface of the frame member 30 to help define the reservoir. This helps to reduce the weight of the containment wall 76. In addition, because the reservoir 20 is outside and surrounds the frame member 30, and because of the relatively large inner and outer radii of the reservoir, the volume of the reservoir can be relatively large but comprise a relatively small reservoir length and height.

In the embodiment shown, the reservoir 20 surrounds part of the chamber 32 and the rear end 34 of the ram 24 when the ram is located in its rearward position. The reservoir 20 is located in front of the front end of the pump 18. The conduit 74 extends in a general rearward direction from the reservoir to the flood area 68 and the pump 18. However, in an alternate embodiment the reservoir could surround part of the pump 18. The present invention provides an advantage in that the longitudinal length of the tool 10 can be reduced. This is because components (in this case the reservoir 20, chamber 32 and part of the ram 24) can occupy a position in a same plane perpendicular to the longitudinal axis A (see FIG. 1). This shortening of the tool length can result in a lighter weight tool, but the shorter length tool can still produce the same longitudinal ram travel length as conventional tools. The present invention can use its three axial pistons with no pronounced pulsations, and is a very compact design. The rotatable assembly 36 can be mounted on a ball bearing assembly which will substantially decrease friction and increase mechanical efficiency. The pump 18 does not use internal seals. This can result in a longer mean time between failures, high reliability and high efficiency due to less internal leakage. The annular symmetrical bladder or reservoir 20 provides adequate reservoir capacity without increasing the tool's length or balance. Serviceability is also better than in conventional tools. The pump can preferably operate at about 550 bar or higher. The present invention can produce a relatively high number of crimps per battery charge due to the high mechanical efficiency. Contributing to the high efficiency are: lack of seals, mechanical balance, clean and unobstructed porting path for hydraulic fluid, lack of high inertial forces, use of bearings and efficient simple planetary gear reduction between the motor and pump. The pump is preferably bi-directional such that it can run in either direction. The present invention allows the tool to be gravity independent. In other words, the pump can operate in any orientation of the tool due to the bladder or reservoir design. The present invention allows the working head to comprise a latch style crimp head with lightweight ergonomic design.

Figure 3A:
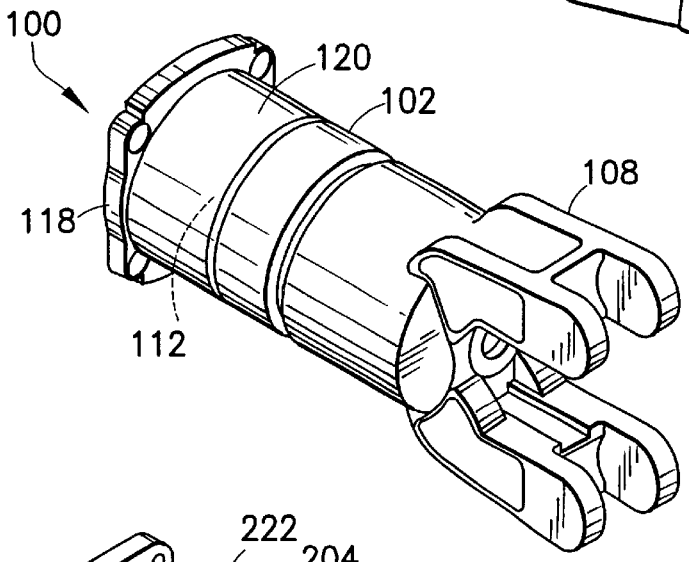
FIG. 3A is a perspective view of a portion of an alternate embodiment of the present invention.
Figure 3B:
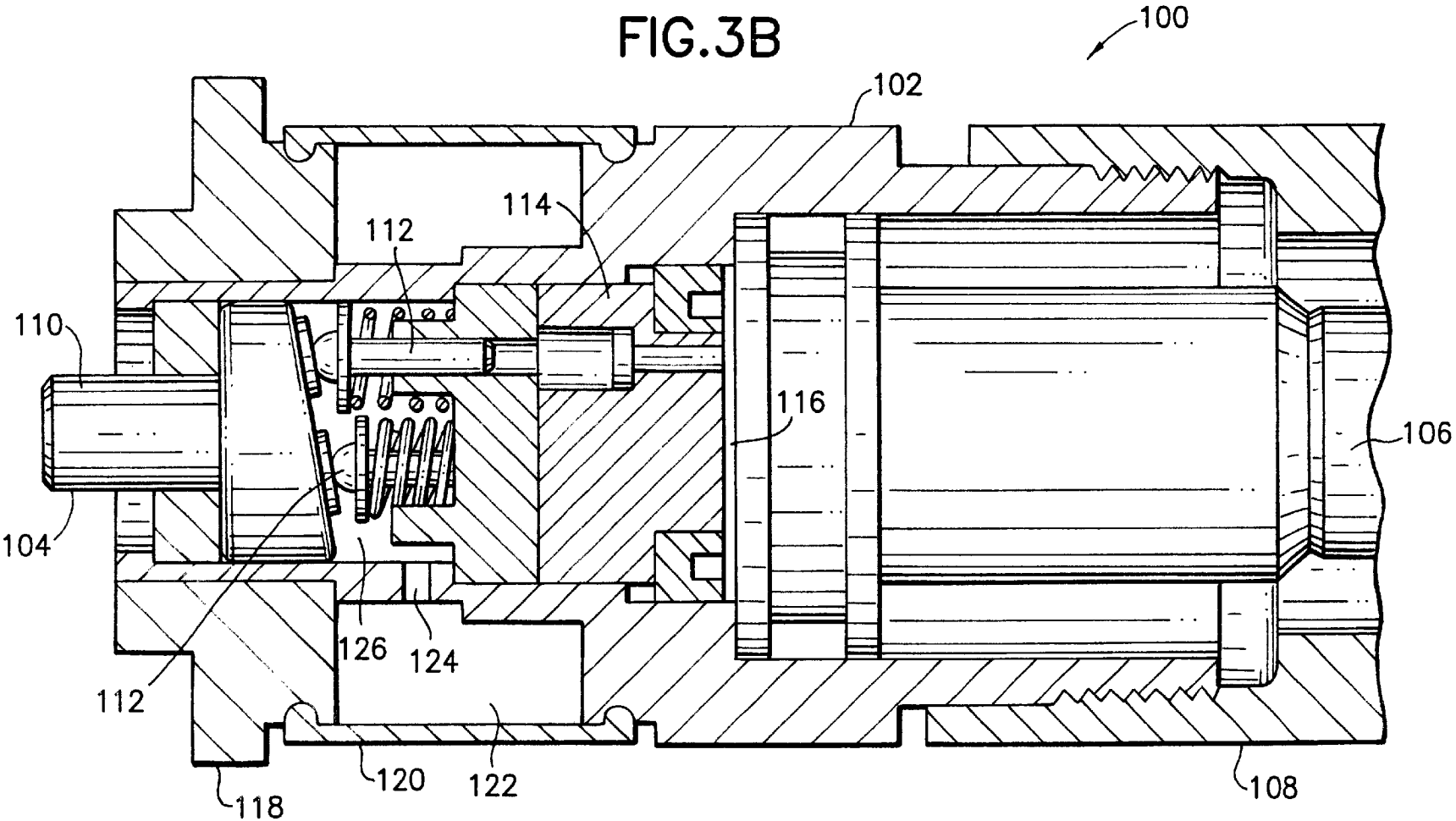
FIG. 3B is a partial cross-sectional view of the tool shown in FIG. 3A.

Referring now to FIGS. 3A and 3B an alternate embodiment of the present invention is shown. In this embodiment a tool subassembly 100 is provided comprising a frame member 102, a pump 104, a ram 106 and rear part 108 of the working head. The pump 104 is similar to the pump 18 shown in FIG. 2 with a rotating assembly 110, spring loaded pistons 112, and a rotationally stationary assembly 114 with conduits into the hydraulic chamber 116 behind the rear end of the ram 106. The frame member 102 surrounds the pump 104. The frame member 102 in conjunction with a rear mounting plate 118 and cover 120 form an annular hydraulic fluid reservoir 122. The frame member 102 has a conduit 124 from the reservoir 122 into a flood area 126 of the pump. This embodiment is intended to illustrate that the tool can be configured to surround the pump and does not need to surround the ram or the ram hydraulic chamber.

Figure 4A:
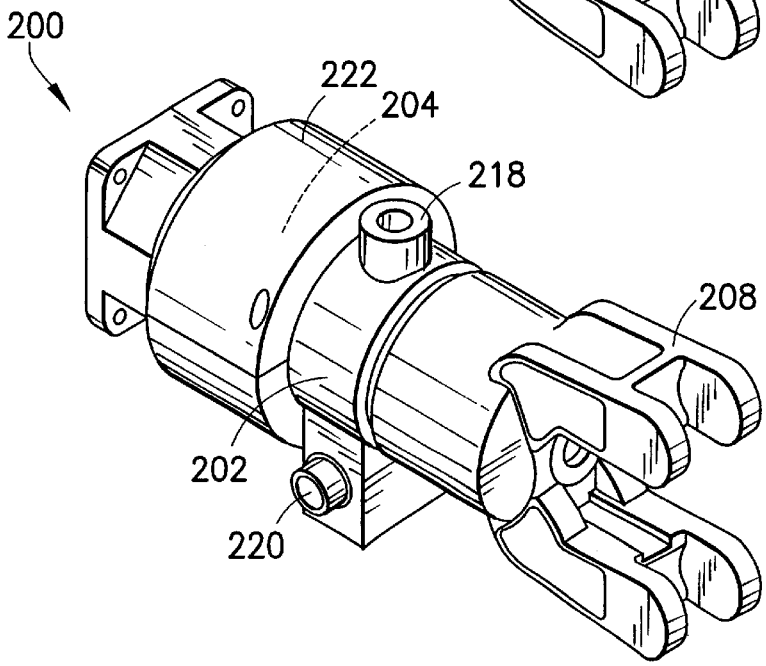
FIG. 4A is a perspective view of a portion of another alternate embodiment of the present invention.
Figure 4B:
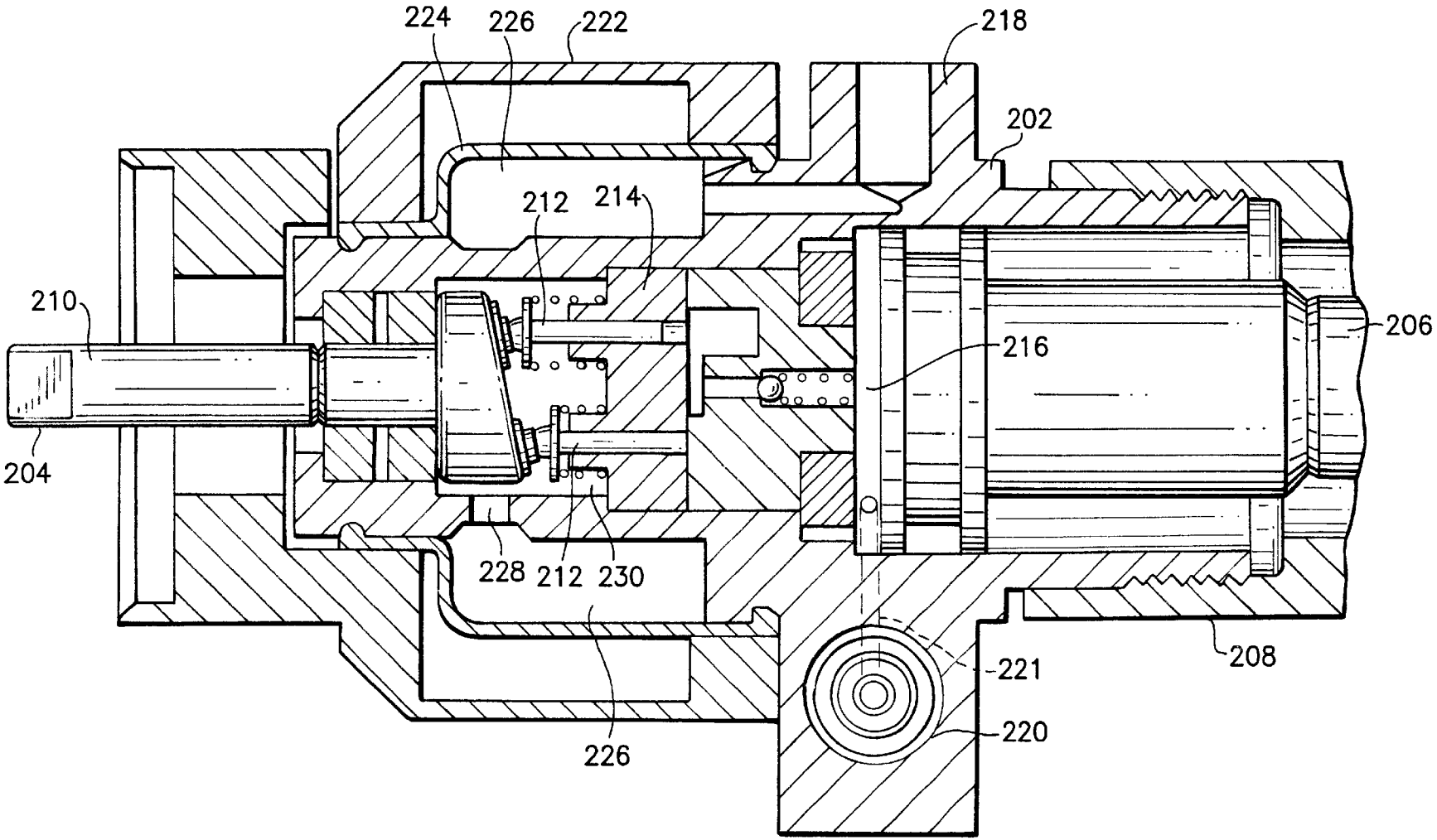
FIG. 4B is a partial cross-sectional view of the tool shown in FIG. 4A.

Referring now to FIGS. 4A and 4B another alternate embodiment of the present invention is shown. In this embodiment a tool subassembly 200 is provided comprising a frame member 202, a pump 204, a ram 206 and a rear part 208 of the working head. The pump 204 is similar to the pumps 18 and 104 with a rotating assembly 210, spring loaded pistons 212, and a rotationally stationary assembly 214 with conduits into the hydraulic chamber 216 behind the rear end of the ram 206. The frame member 202 has a mount 218 for filling the reservoir 226 with hydraulic fluid and a mount 220 for connecting a hydraulic fluid supply and return line (not shown) for connection to an auxiliary pump (not shown). Conduit 221 extends between mount 220 and chamber 216 for moving the ram. 206 by moving hydraulic fluid through mount 220 and conduit 221. A cover 222 is connected to the frame member 202 with a bladder or flexible resilient member 224 therebetween. An annular reservoir 226 is formed between the frame member 202 and the annular bladder 224. The frame member 202 includes a hole 228 between the reservoir 226 and the pump flood area 230. The bladder 224 can expand and contract with flow of hydraulic fluid into and out of the reservoir 226. The cover 222 prevents the bladder 224 from being accidentally ruptured.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A hand-held, battery operated, hydraulically actuated tool comprising:

a battery;

a motor connected to the battery;

a frame connected to the battery and the motor, the frame comprising a hydraulic fluid conduit system;

a hydraulic fluid pump connected to the frame and the motor, wherein the pump comprises pistons biased by springs, a rotating wobble drive member connected to the motor, and a hydraulic fluid flood area of the frame, the flood area surrounding the pistons and connections of the pistons to the wobble drive member with hydraulic fluid in the flood area;

a ram movably connected to the frame and adapted to be moved relative to the frame by hydraulic fluid pumped by the pump; and a hydraulic fluid reservoir connected to the pump, the reservoir being located proximate an exterior portion of the frame along a path of at least about relative to a longitudinal axis of the tool, wherein the reservoir does not extend beyond a rear end of the frame.

2. A tool as in claim 1 wherein the reservoir is defined by an exterior surface of the frame and a containment wall connected to the frame.

3. A tool as in claim 2 wherein the exterior surface comprises a groove into the frame along an exterior side of the frame.

4. A tool as in claim 3 wherein the groove is a substantially annular groove.

5. A tool as in claim 2 wherein the containment wall comprises a resilient member which can collapse towards the exterior surface of the frame as hydraulic fluid is pumped out of the reservoir.

6. A tool as in claim 5 further comprising a substantially rigid reservoir cover connected to the frame over the resilient member, and wherein the cover has a general arced shape.

7. A tool as in claim 1 wherein the reservoir is located in a plane perpendicular to the longitudinal axis of the tool, the plane extending in an area between the pump and the ram.

8. A tool as in claim 7 wherein the plane extends between a front end of the pump and a rear end of the ram.

9. A tool as in claim 1 wherein the path is about 360°.

10. A tool as in claim 1 wherein the reservoir comprises a general ring shape and wherein a portion of the ram is locatable inside the general ring shape.

11. A hand-held, battery operated hydraulically actuated tool comprising:

a battery;

a motor connected to the battery;

a frame connected to the battery and the motor, the frame comprising a hydraulic fluid conduit system;

a hydraulic fluid pump connected to the frame;

a ram movably connected to the frame and adapted to be moved relative to the frame by hydraulic fluid pumped by the pump; and a hydraulic fluid reservoir connected to the pump, the reservoir being located proximate an exterior portion of the frame along a path of at least about 180° relative to a longitudinal axis of the tool, and wherein the reservoir does not extend beyond a rear end of the frame;

wherein the frame comprises a generally straight hydraulic fluid conduit extending in a general rearward direction directly from the reservoir to the pump.

12. A tool as in claim 11 wherein the conduit directly connects the reservoir to the pump without any valves therebetween.

13. In a hand-held, battery powered hydraulic compression tool comprising a frame, a hydraulic fluid pump on the frame, a hydraulic fluid reservoir connected to the pump, and a ram movably connected to the frame, wherein the improvement comprises:

the hydraulic fluid reservoir having a general ring shape surrounding a portion of the frame, and being connected by a conduit to the pump without any valves located between the reservoir and pump.

14. A tool as in claim 13 wherein an inner perimeter of the reservoir is formed by an outer perimeter of the portion of the frame.

15. A tool as in claim 14 wherein the reservoir comprises a resilient bladder member surrounding the portion of the frame.

16. A tool as in claim 14 wherein the portion comprises an annular groove into an exterior surface of the frame.

17. A tool as in claim 13 wherein the reservoir is located at least partially in front of a front end of the pump.

18. A tool as in claim 13 wherein the reservoir is located at least partially surrounding a portion of the ram when the ram is in a rearward position.

19. A tool as in claim 13 wherein the reservoir is located in a plane between a front end of the pump and a rear end of the ram.

20. In a hand-held, battery powered hydraulic compression tool comprising a frame, a hydraulic fluid pump on the frame, a hydraulic fluid reservoir connected to the pump, and a ram movably connected to the frame, wherein the improvement comprises:

the hydraulic fluid reservoir having a general ring shape and communicating through a valueless conduit with a flood area surrounding the pump.

* * * * *

UNITED STATES PATENT AND TRADEMARK OFFICE

CERTIFICATE OF CORRECTION

PATENT NO. : 6,453,719 B1
DATED : September 24, 2002
INVENTOR(S) : Heskey et al.

It is certified that error appears in the above-identified patent and that said Letters Patent is hereby corrected as shown below:

Column 5,
Line 24, change “about relative” to -- about 180° relative --

Signed and Sealed this

Eighteenth Day of February, 2003

JAMES E. ROGAN
*Director of the United States Patent and Trademark Office*